US005280460A

United States Patent [19]

Bron

[11] Patent Number: 5,280,460

[45] Date of Patent: Jan. 18, 1994

[54] GEAR MECHANISM ESPECIALLY FOR TIMEPIECE

[75] Inventor: Alphonse Bron, Bassecourt, Switzerland

[73] Assignee: ETA S.A. Fabriques d'Ebauches, Granges, Switzerland

[21] Appl. No.: 702,915

[22] Filed: May 20, 1991

[30] Foreign Application Priority Data

May 21, 1990 [CH] Switzerland ..... 01716/90

[51] Int. Cl.[5] ..... G04F 7/00

[52] U.S. Cl. ..... 368/106; 368/113

[58] Field of Search ..... 368/101, 113, 185, 190, 199

[56] References Cited

U.S. PATENT DOCUMENTS 5,113,382 5/1992 Bron ..... 368/106

*Primary Examiner*—Bernard Roskoski

*Attorney, Agent, or Firm*—Weil, Gotshal & Manges

[57] ABSTRACT

A gear mechanism for use in horology is described. The gear mechanism not only returns one of the wheels therein to its original position but also carries along with it a second wheel thereby enabling the mechanism to be made thinner and reducing the number of parts needed to carry out these two functions. The mechanism has a first wheel and a second wheel, the first wheel constituting a toothed wheel fitted on an axis on which is fixed a heart-shaped cam, the point of this cam functioning as the gear engaging means for the second wheel, the cam enabling return of the said first wheel to its starting position by means of a hammer. The invention is of particular value in chronographs.

9 Claims, 7 Drawing Sheets

GEAR MECHANISM ESPECIALLY FOR TIMEPIECE

The present invention relates to a gear mechanism especially for use in timepieces.

BACKGROUND OF THE INVENTION

Heart-shaped cams are often used in horology especially in chronographs, and they are therefore designated "chronograph-hearts". The heart is fixed on the wheel of a counter of the chronograph to permit resetting of the hand of this counter to zero after the setting in operation and the stopping of the chronograph.

DESCRIPTION OF THE PRIOR ART

An example of such a construction is to be found in U.S. Pat. No. US-A-3,901,020. In this case, the heart of the second counter is mounted on an axis which carries the chronograph wheel as well as a drive member, these elements being superimposed the one on top of the other on this axis.

FIGS. 1 to 4 of the attached drawings show other cam constructions in the form of a heart of the prior art as well as their method of operation.

Thus, in FIG. 1 it may be seen that the profile of the heart 1 has a point 2 and two opposing lateral rounded surfaces 3 and 4 called shoulders. This heart is provided with an orifice 5 essentially between the two shoulders 3 and 4 whose axis is perpendicular to the general plane of the cam and which permits this heart to be mounted on the axis 6 of the wheel 7 of a counter, for example the second counter or the minute counter of a chronograph. As may be seen in FIG. 2 the shoulders 3 and 4 may also be slightly pointed.

FIGS. 3*a* to 3*d* show a view from above of the successive stages of a classical zero resetting mechanism of a chronographic counter, with the aid of such a cam in the form of a heart. This zero resetting mechanism is operated by a hammer 8 having at one of its extremities an incline 9 and being pivoted at its other extremity about a fixed axis 10. The hand of the counter which is represented schematically is fixed on the axis 6 of the wheel 7 and is indicated by the reference numeral 11.

On operating the chronograph the hammer 8 is spaced apart from the wheel 7 as is shown in FIG. 3*a*, and this wheel may thus turn in a clockwise direction, carrying with it the hand 11. When the chronograph is stopped, which is carried out by means not described here, but which one may for example find in the specification of the above mentioned patent, the wheel 7 is stopped and the hand 11 indicates the elapsed time since operation of the chronograph assuming that the wheel 7 is the only counter of the chronograph. It should in general be noted that chronographs are equipped with three counters (hours, minutes and seconds) which are all equipped with a heart similar to that described above.

By the operation of a mechanism not shown in FIG. 3*a*, it is possible to pivot the hammer 8 in the direction of the arrow F until its inclined surface 9 comes into contact with the periphery of the heart 1. This results in the mechanism being in the configuration shown in FIG. 3*b*. The hammer being connected to a push button for zero resetting, one can exert a force which is transmitted to the heart 1 and since the latter is eccentrically mounted with respect to the axis 6 it freely pivots (FIG. 3*c*) until the incline 9 comes into contact with the two shoulders 3 and 4 (see FIG. 3*d*). In this position the hand 11 is returned to its original or reference position.

In this case the heart 1 has only functions to return the wheel 7 of the counter to zero. Apart from this, as already described above, it is often necessary, apart from this wheel 7 of the counter, which is for example a second counter, also to drive another wheel, for example a minute counter.

FIG. 4 shows the technique of the prior art enabling a second counter wheel to be driven. To this effect above the heart 1, there is disposed a drive member 12 which extends beyond the periphery of the cam in a manner such as to enable it to engage with an intermediate wheel 13 which in its turn meshes with a second counter wheel 14 which is itself equipped with a heart 15. When starting the chronograph the hammer 8 is not in contact with the heart 1, and the wheel 7 is thus able to drive both of the wheels 13 and 14 by the intermediary of its drive member 12. Thus when the wheel 7 has a made a complete revolution the drive member 12 allows the wheels 13 and 14 to advance by one step.

When the chronograph is reset to the zero position the wheel 13 is displaced axially out of the plane of the drive member 12 (upper position represented by dotted lines). The hammer 8 thus returns the second counter of the wheel 7 to zero; as has already been explained above.

In this earlier apparatus, as in the above mentioned patent, the drive member 12 is placed out of the plane of the heart so as to engage with the wheel 13 and not to interfere with the action of the hammer 8. In effect if this drive member 12 were placed directly on the upper surface of the wheel 7 of the counter, in the same plane as the heart 1, it risks thus in certain conditions to come within the trajectory of the hammer 8 during the zeroing action which would thereby block the latter.

In any case such an apparatus increases the height of the group formed by the heart 1, the wheel 7 of the counter and the drive member 12. It would in any case be desirable whilst maintaining the zero resetting functions on the one hand and the drive of the other counters on the other hand to reduce the height occupied by the members carrying out these functions.

The discussion of the prior art given above is applicable to gear mechanisms used in timepieces, such as in chronographs. However, the invention is not limited to this field of application. On the contrary, it may also be used with advantage for other applications in each case where the return of a set of mobile rotating members to the initial position is involved. Thus, it may for example be used in other counting mechanisms.

BRIEF SUMMARY OF THE INVENTION

The present invention therefore relates to a gear mechanism having a first rotatable wheel and a second rotatable wheel, the said first wheel being adapted to be driven by a driving force from an initial position to a final position, the said first wheel comprising a toothed wheel to which said driving force may be applied, said toothed wheel being mounted on an axis, a cam integral rotatably with said toothed wheel, as well as gear means adapted to engage with said second wheel in a predetermined reduction ratio with respect to the first said wheel, said gear mechanism also comprising means cooperating with said cam to return said first wheel to its initial position.

According to the invention these gear means adapted to engage with the second wheel form part of the profile of the said cam.

BRIEF DESCRIPTION OF THE INVENTION

Due to these features of the invention and also as a result of their particular shape, the heart carries out two functions, not only the conventional function of returning to zero, but also the function of driving other members of the gear system. Thus the mechanism is simplified in construction in that one reduces the number of parts necessary to obtain the same result and furthermore there is a reduction in the thickness since it is possible to dispense with the drive member which is outside the plane of the cams. This latter feature confers on the invention a particular advantage in its application to a chronograph mechanism since it is a continuous aim to reduce the thickness of this apparatus as much as possible.

BRIEF DESCRIPTION OF THE DRAWINGS

The invention will now be further described by way of example with respect to one embodiment of the invention and by way of non-limiting example with reference to the accompanying drawings in which.

DETAILED DESCRIPTION OF THE INVENTION

Figure 7:
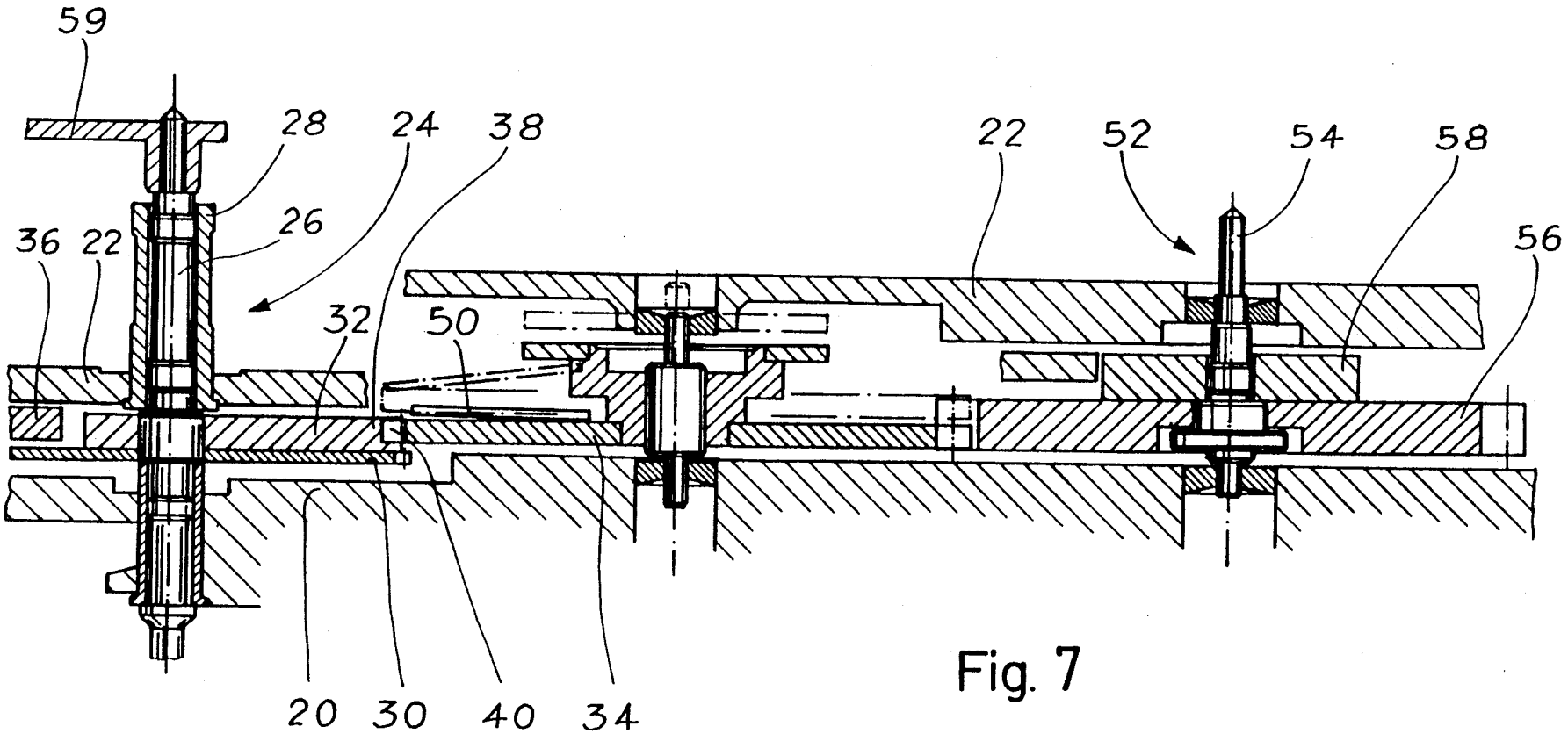
FIG. 7 is a sectional view of part of a gear mechanism and of the cam according to the invention along the line VII—VII of FIG. 5, FIGS. 8 and 9 show various mechanisms of action of a hammer on a cam according to the invention.

FIG. 7 shows a gear mechanism according to the invention applied to a chronograph mechanism. In this case, the gear mechanism is mounted between a plate 20 and a bridge 22. The mechanism comprises a first wheel 24 constituting in this case the second hand and which has an axis 26 rotatably mounted in a pipe 28 fixed on the bridge 22. A toothed wheel 30 is mounted on the axis 26 and which can be driven by a driving force from horological drive mechanism (not shown) so that it drives the first wheel 24. This latter is thus driven from its initial position to a final position. A cam 32 in the shape of a heart is integral rotatably with the wheel 30. The mechanism also has a second wheel 34 which, as will be explained hereinafter, is coupled to the first wheel 24 by way of a predetermined reduction ratio. The gear mechanism also includes means 36 cooperating with the said cam 32 to return the first wheel 24 to its initial position. In this particular case, these means 36 comprise a hammer articulated on the plate 20 at a position not shown in FIG. 7.

Figure 6:
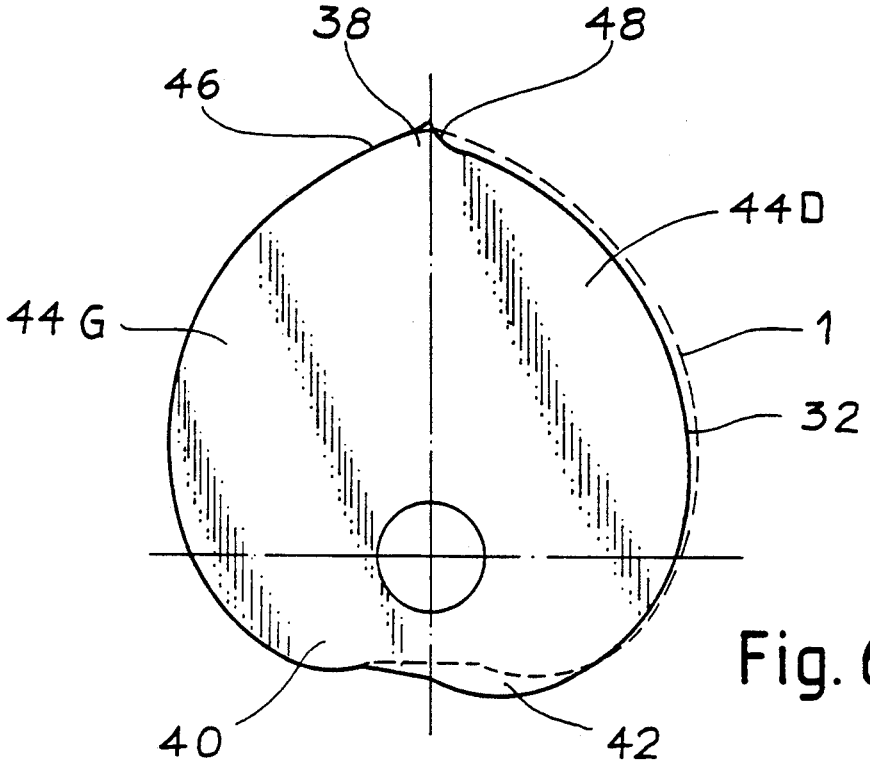
FIG. 6 shows a comparative illustration of the contours of a cam of the prior art and of a cam according to the invention.

FIG. 6 illustrates the difference between the profile of the conventional heart 1, which is symmetrical, shown in dotted lines and the profile of the heart 32 according to the invention which is asymmetrical. The heart 32 has a point 38 and two shoulders 40 and 42. The heart according to the invention being asymmetrical, it has a left-hand half 44G and a right-hand half 44D, having a curvature different from that of the left half 44G. In addition it will be noted that the point 38 has a different shape from that of the conventional heart 1 since it has a rectilinear edge 46 at the left and a concave configuration 48 at the right.

It should be noted that the terms right and left are used with reference to FIG. 6 in which the cam 32 rotates in a clockwise direction under the action of the aforementioned driving force. Consequently the concave edge 48 is in the forward position during movement of the first wheel 24 and the straight edge 46 is towards the back.

Figure 1:
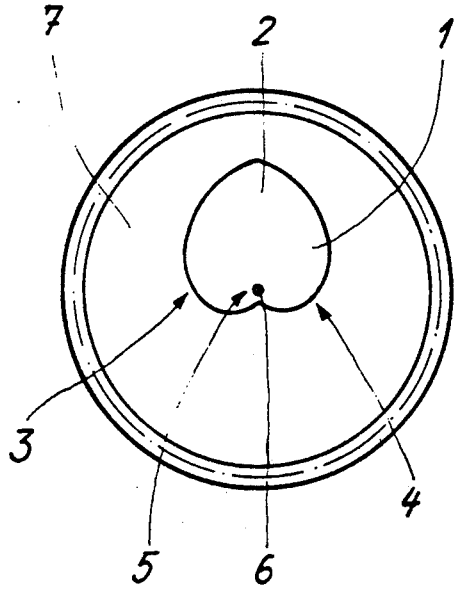
FIGS. 1 and 2 show plans illustrating the contours of the heart-shaped cams of the prior art and in two embodiments.
Figure 2:
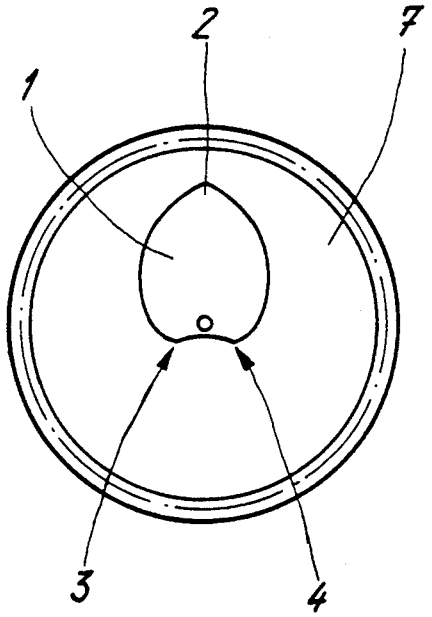
Figure 3A:
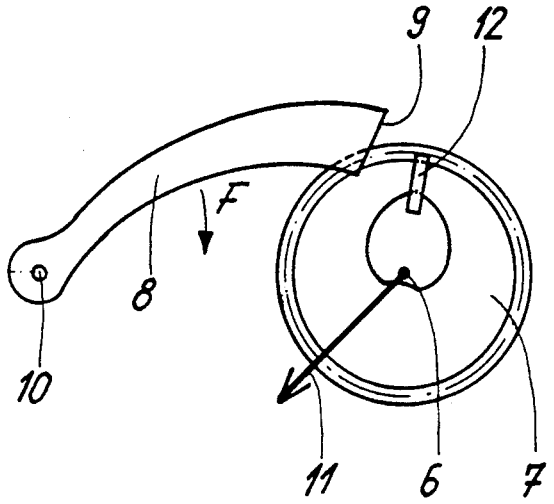
FIGS. 3*a* 3*d* show successive stages in a classical apparatus for returning a wheel of a counter to zero by way of a heart-shaped cam.
Figure 3B:
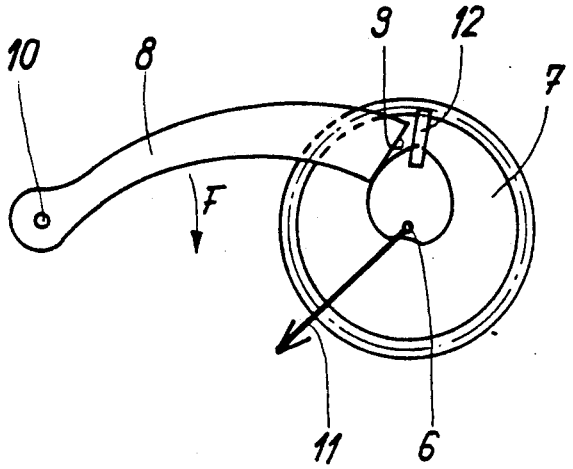
Figure 3C:
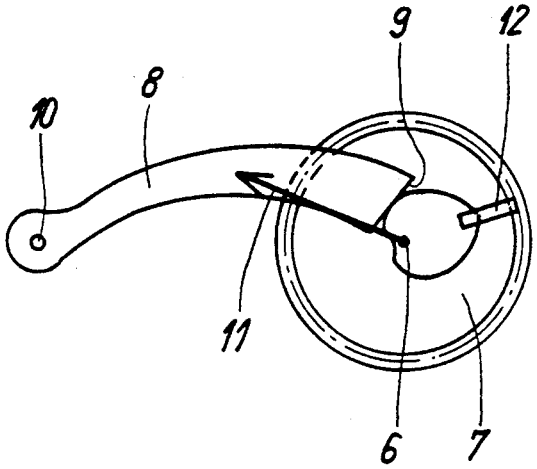
Figure 3D:
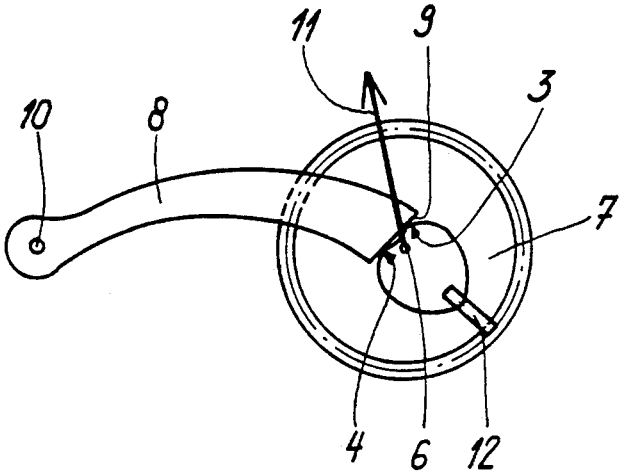
Figure 4:
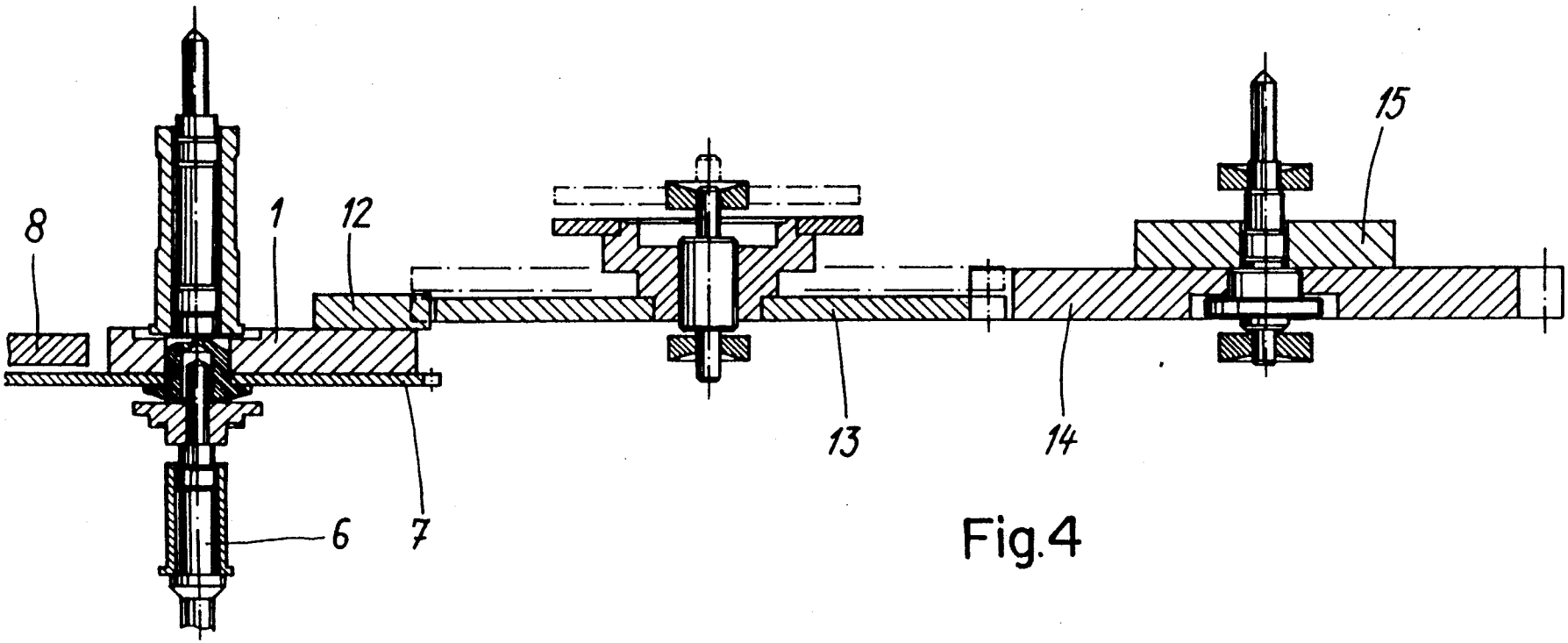
FIG. 4 shows a sectional view of part of a gear mechanism in a chronograph of the prior art.
Figure 5:
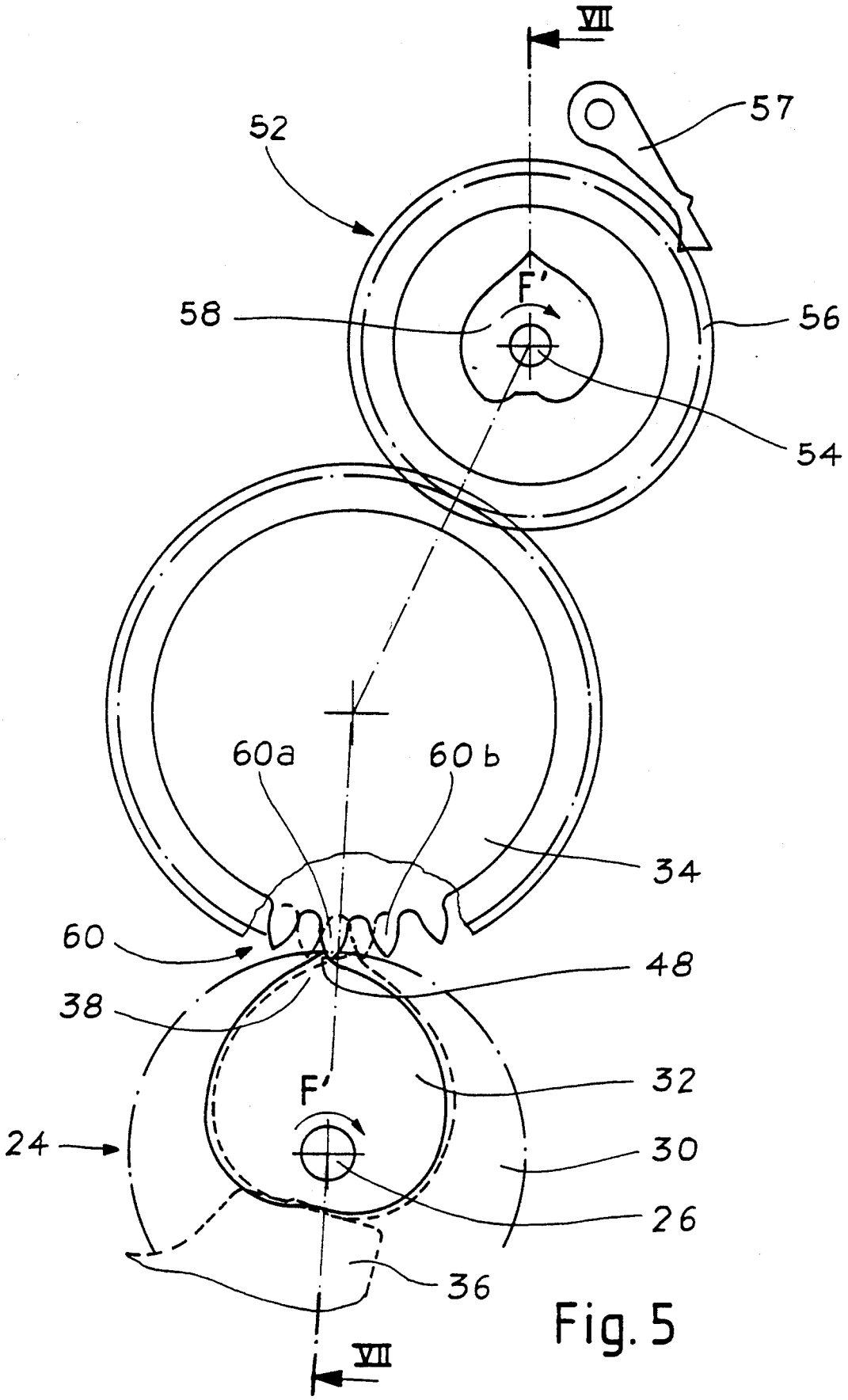
FIG. 5 is a view from above of a cam according to the invention engaging with other wheels of a gear mechanism.

As shown in FIG. 5 the point 38 of the heart 32 engages with the teeth of the second wheel 34 which is in the present case an intermediate wheel. In other words, this point 38 forms part of the profile of the cam 32 and serves as the engagement means in order to advance the second wheel 34.

FIG. 7 shows that the second wheel may be displaced axially in order to be moved out of the plane of the cam 32 under the action of a blade 50 which is capable of raising it when the hammer 36 acts on the cam 32. In this embodiment of the invention the second wheel 34 engages in its turn with a third wheel 52 having an axis 54 on which a wheel 56 and a cam 58 are fixed. A more detailed description of these features of the invention may be found in the specification of Swiss Patent Application No. 01261/90-7 of the present applicant.

When the mechanism described is used in a chronograph, the first wheel 24 may for example be the second counter whereas the third wheel 52 may be the minute counter. The reduction ratio between these two counters is thus 60:1.

The functioning of the mechanism will now be described with reference to FIGS. 5 and 7.

When the driving force is applied to the wheel 30 the latter turns in a clockwise direction (arrow F') driving with it the hand 59 (only shown in FIG. 5) which is connected to an axis 26. The wheel 30 thus also drives rotatably the second wheel 34.

For ease of explanation, two of the teeth 60 of the second wheel 34 have been numbered 60*a* and 60*b*. For each revolution of the first wheel 24 the leading attack edge 48 of the point 38 comes in contact with one of the teeth 60 of the second wheel 34, for example and as shown in FIG. 5, the tooth 60*a*. The point 38 of the heart 32 thus advances the tooth 60*a* by a half step in the counter-clockwise direction of a clock up to the position situated between the original positions of the teeth 60*a* and 60*b* (represented by dotted lines).

Where there is movement of the second wheel 34, the third wheel 52 is also rotated, and the wheel 56 is displaced by a half step in the direction of the arrow F'. Moreover, this wheel 56 is held in position by a jumper 57 which is in a stable position only when its end is situated between two teeth of the said toothed wheel 56. This jumper 57, when it is in an unstable position, thus causes the movement of the wheel 56 by a further half step in the direction of the arrow F' in order to regain its stable position. This rotation of the wheel 56 thus also causes a displacement of the wheel 34 by a half step. The tooth 60*a* thus takes up the initial position of the tooth 60*b*.

In other words, one might regard each rotation of one turn of the first wheel 24 as involving a rotation of the second wheel 34 by two half steps, the displacement of the first half step being effected by the heart 32 and that of the second half step by means of the jumper 57. It should be noted here that the profile of the point 38 of the cam 32 is exactly adapted to that of the extremity of the tooth 60, thereby ensuring good meshing of the gears.

When the final position of the wheels is reached (in the case of chronographs when the time to be measured has expired), the movements described above are stopped and since the hand 59 indicates the position of the first wheel 24, it is possible to reach the time expired since starting the mechanism to be read.

One therefore proceeds to reset the first wheel 24 to its starting position by the action of the hammer 36 as described above with reference to FIGS. 3*a* to 3*d*. One should note here that the first wheel 24 may be brought back to its starting position, both by rotation in a clockwise direction and also by rotation in the opposite direction.

Figure 8:
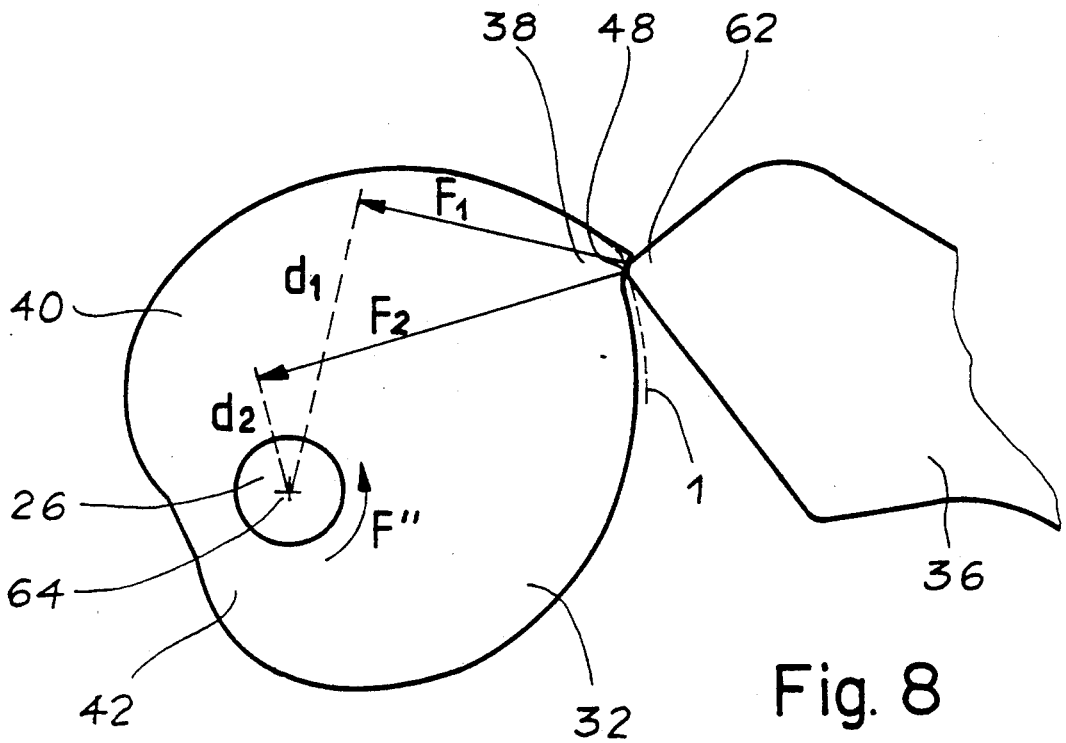

FIG. 8 illustrates the resetting into the starting position in the special case where the hammer 36 and in particular its point 62 makes contact with the concave edge 48 of the point 38 of the heart 32.

If one considers that $F_1$ represents the force applied by the hammer 36 perpendicular to the surface of the concave edge 48 and that $d_1$ is the distance of the axis 64 of rotation of the wheel 24 from the normal of $F_1$, the moment $M_1$ exerted by the hammer 36 on the heart 32 is equal to $F_{1\times d1}$. In the same way, if one assumes that $F_2$ represents the force exerted by the hammer 36 perpendicular to the edge of the point of a conventional heart 1 (shown in dotted lines) and that $d_2$ is the distance of the axis 64 from the normal of $F_2$ one may see that the moment $M_2$ is equal to $F_{2\times d2}$, which is less than the moment $M_1$.

The special shape of the point 38 of the heart 32 thus improves the resetting into the starting position of the wheel. It may be noted that this latter thus pivots in a counter clockwise direction (direction of the arrow F″).

Figure 9:
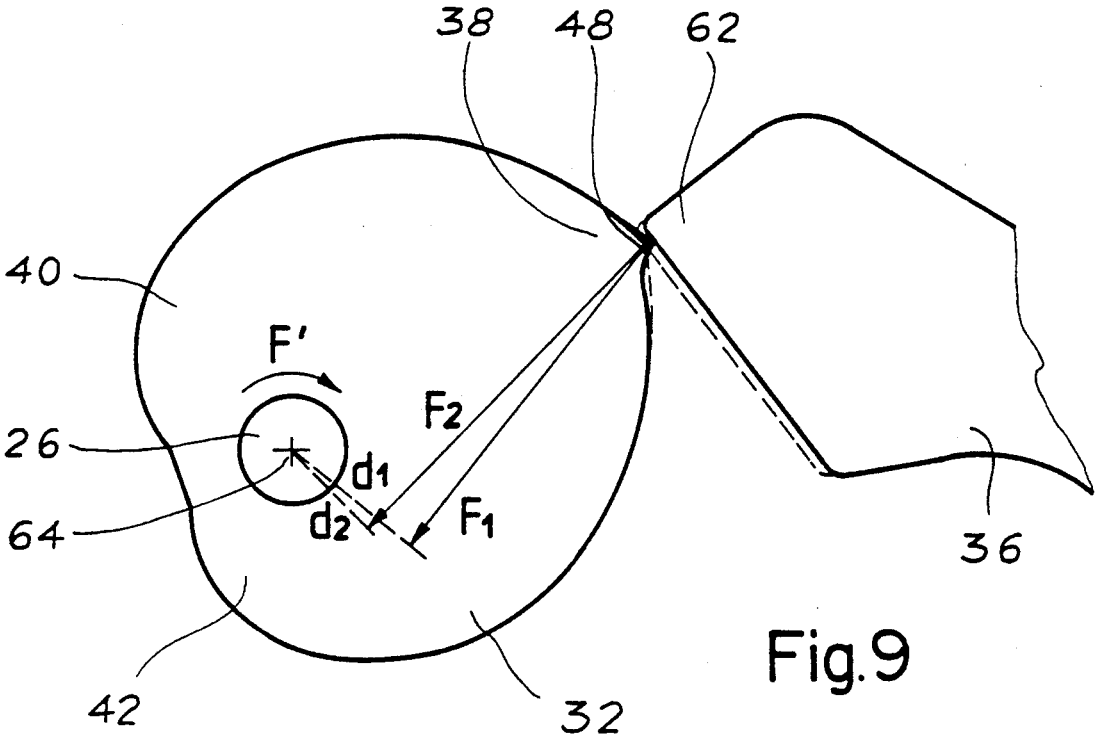

FIG. 9 shows the particular case where the hammer 36 makes contact with the point 38 of the heart 32. In this case, the moment $M_1$ is only slightly superior to the moment $M_2$, but it still results in a slight improvement in the resetting into the starting position. It may be noted that in this case the wheel 24 is driven in a clockwise direction (direction F′).

Figure 10:
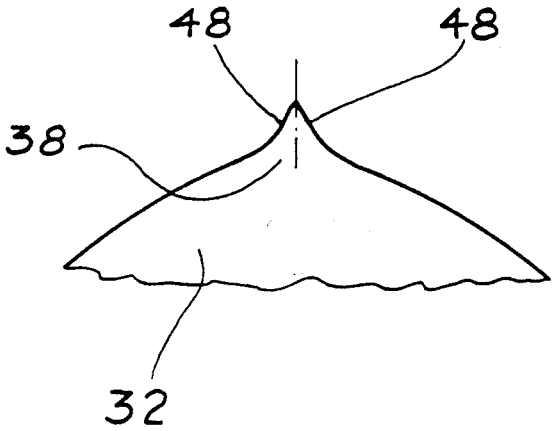
FIG. 10 is a detailed view of a second embodiment of the invention of the point of the heart-shaped cam.

In another embodiment of the invention the point 22 of the heart 20B may have two concave surfaces 48 (see FIG. 10).

I claim:

1. A gear mechanism comprising:

a first rotatable wheel assembly;

a second rotatable wheel; and means for exerting a torque on said first wheel assembly, said first wheel assembly including:

a toothed wheel mounted for rotation about a first axis for receiving a driving force from a driving mechanism; and a cam having a profile, said cam being rigidly locked with said toothed wheel for rotation therewith, said profile both engaging said second wheel for driving said second wheel in rotation with a predetermined reduction ratio with respect to said first wheel assembly, said torque exerting means including means acting on said cam for selectively returning said first wheel assembly from any rotational position to an initial position.

2. A gear mechanism according to claim 1 wherein the cam is in the form of a heart having a sharp point.

3. A gear mechanism according to claim 2 wherein said point of said cam has at least one concave edge.

4. A gear mechanism according to claim 3 wherein the concave edge is provided at the side of the point which is the leading side with respect to the movement of the first wheel under the action of said driving force.

5. A gear mechanism according to claim 4 wherein the said point further has a straight edge provided at the side of the point which is trailing with respect to the movement effected by said first wheel under the action of said driving force.

6. A gear mechanism according to claim 1 wherein said second wheel is mounted for rotation about a second axis parallel to said first axis and further including means for axially moving said second wheel for disconnecting said second wheel from said cam when said first wheel assembly is returned to said initial position.

7. A gear mechanism according to claim 1 further including a position indicator locked to said first wheel assembly for rotation therewith.

8. A gear mechanism according to claim 7 wherein said indicator means includes a hand.

9. A gear mechanism according to claim 1 wherein said torque exerting means is a hammer.

* * * * *